US008979716B1

(12) United States Patent
Rawlins

(10) Patent No.: US 8,979,716 B1
(45) Date of Patent: Mar. 17, 2015

(54) PORTABLE EXERCISE EQUIPMENT

(71) Applicant: Kenneth C. Rawlins, Newport Beach, CA (US)

(72) Inventor: Kenneth C. Rawlins, Newport Beach, CA (US)

( * ) Notice: Subject to any disclaimer, the term of this patent is extended or adjusted under 35 U.S.C. 154(b) by 0 days.

(21) Appl. No.: 14/310,912

(22) Filed: Jun. 20, 2014

(51) Int. Cl.
*A63B 21/002* (2006.01)
*A63B 21/00* (2006.01)
*A63B 21/04* (2006.01)

(52) U.S. Cl.
CPC ..... *A63B 21/0442* (2013.01)
USPC ..... 482/91; 482/129; 482/96

(58) Field of Classification Search
USPC ..... 482/121–129, 139, 18, 904, 91, 148, 482/95–96
See application file for complete search history.

(56) References Cited

U.S. PATENT DOCUMENTS 4,537,393 A * 8/1985 Kusch ..... 482/10
5,042,798 A * 8/1991 Sawicky ..... 482/129
5,197,410 A * 3/1993 Wilson et al. ..... 119/776
5,256,119 A * 10/1993 Tudor ..... 482/74
5,415,609 A * 5/1995 Yang ..... 482/147
5,951,443 A * 9/1999 Askins ..... 482/74
6,152,857 A * 11/2000 Gonzalez-Leal ..... 482/10
6,202,263 B1 3/2001 Harker
6,267,711 B1 * 7/2001 Hinds ..... 482/121
6,402,668 B1 6/2002 Harker
6,840,894 B2 * 1/2005 Lerner ..... 482/124
6,921,354 B1 7/2005 Shifferaw
6,941,620 B1 * 9/2005 Hinds ..... 24/134 R
7,044,896 B2 5/2006 Hetrick
7,090,622 B2 8/2006 Hetrick
7,104,935 B2 * 9/2006 Matsuoka ..... 482/124
7,651,448 B2 1/2010 Hetrick
7,722,508 B2 5/2010 Hetrick
7,762,932 B2 7/2010 Hetrick
7,785,243 B2 * 8/2010 Kassel ..... 482/122
7,785,244 B2 8/2010 Hetrick
7,806,814 B2 10/2010 Hetrick
7,955,236 B2 * 6/2011 DiGiovanni et al. ..... 482/124
8,007,413 B1 * 8/2011 Wu ..... 482/91
8,043,197 B2 * 10/2011 Hetrick ..... 482/91
8,083,653 B2 12/2011 Hetrick
8,192,338 B2 * 6/2012 Solow et al. ..... 482/142
D669,945 S 10/2012 Russo et al.
8,708,873 B2 * 4/2014 Birch et al. ..... 482/129
2007/0027005 A1 2/2007 Hetrick
2009/0075790 A1 3/2009 Hetrick
2009/0105053 A1 4/2009 Hetrick
2010/0267531 A1 10/2010 Hetrick
2011/0059829 A1 3/2011 Hetrick (Continued)

OTHER PUBLICATIONS

P90X. Wikipedia: The Free Encyclopedia. Wikimedia Foundation, Inc. Web. Mar. 3, 2013.

(Continued)

*Primary Examiner* — Stephen Crow
(74) *Attorney, Agent, or Firm* — Knobbe Martens Olson & Bear LLP

(57) ABSTRACT

A portable exercise device includes an anchor portion, a swivel portion, one or more elongate straps, springs or elastic cords, and handles. The swivel portion may allow the elongate straps to rotate without getting tangled. The springs may be placed in series or in parallel with at least part of the elongate straps. Two or more springs, of different lengths, may be placed in parallel to achieve a changing spring constant of the system, depending on displacement of the handle.

17 Claims, 16 Drawing Sheets

(56) References Cited

U.S. PATENT DOCUMENTS

| | | | |
|---|---|---|---|
| 2012/0053027 | A1 | 3/2012 | Hetrick |
| 2012/0077646 | A1 | 3/2012 | Hetrick |
| 2012/0142506 | A1 | 6/2012 | Hetrick et al. |
| 2013/0029813 | A1 | 1/2013 | Hetrick et al. |
| 2013/0190148 | A1 | 7/2013 | Allison et al. |
| 2014/0266481 | A1 | 9/2014 | Shanan |

OTHER PUBLICATIONS

Complaint filed on Mar. 11, 2011 in *Fitness Anywhere, Inc.* v *Lifeline International*, 11cv156, Case 2:11-cv-00156-HCM-DEM (District of Alexandria, Virginia).

First Amended Complaint filed on Apr. 15, 2011 in *Fitness Anywhere, Inc.* v *Lifeline International*, 11cv156, Case 2:11-cv-00156-HCM-DEM (District of Alexandria, Virginia).

Web page titled "The Shake Weight Hits $40 Million in Sales," http://www.cnbc.com/id/38788941, 2 pages, printed on Mar. 22, 2013; published on Aug. 20, 2010.

Web page titled "RipSwitch," https://www.youtube.com/watch?v=6Ow9l_zA8YY &list=FLGNG5vskTzWVhkZIQCw5qyw&index=3, published by Kasper Allison on Jan. 23, 2013.

Web page titled "TV's Top-Selling Infomercial Products," http://abcnews.go.com/Business/story?id=86861&page=1, 3 printed pages, printed on Nov. 20, 2014.

Complaint filed on Apr. 14, 2014 in *Fitness Anywhere LLC* v. *Woss Enterprises LLC*, Case 5:14-cv-01725-BLF (U.S. District Court for the Northern District of California).

* cited by examiner

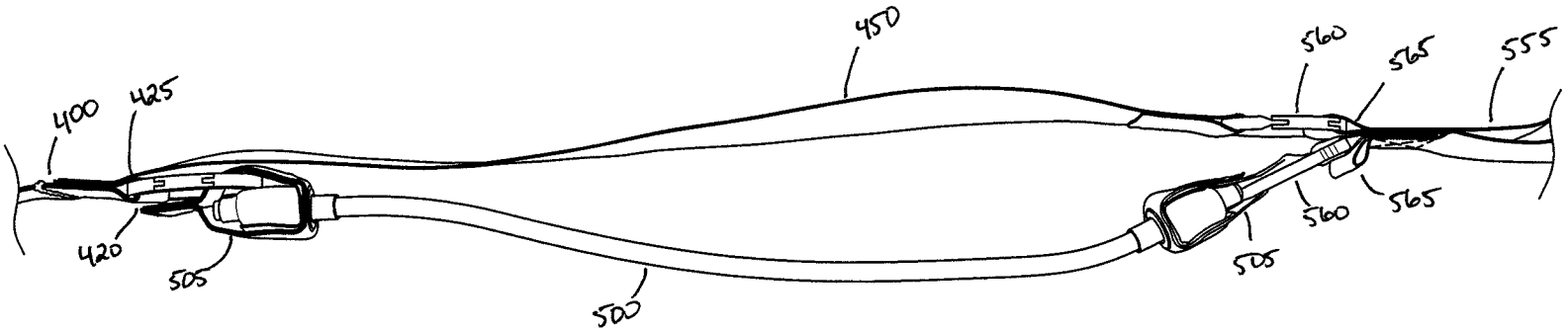
555
565
565
560
565
565
565

PORTABLE EXERCISE EQUIPMENT

BACKGROUND

1. Field of the Invention

The present technology generally relates to exercise portable equipment.

2. Description of the Related Art

There exists various types of exercise equipment. Most of the equipment is heavy and must reside in a single place. This equipment often uses metal weights for resistance, which are often tens, or hundreds of pounds in weight. The exercise equipment that supports these weights often weighs hundreds of pounds themselves. Additionally, each piece of exercise equipment may only provide a user with a limited number of exercises that can be performed on that piece of equipment. In some cases, only a single exercise may be performed on a single piece of equipment.

Some exercise equipment can be portable. These systems allow the user to engage the exercise equipment at home or while traveling. The portable exercise equipment generally comprises an anchor portion, intermediate straps, and two handles. However, these pieces of equipment are cumbersome and difficult to use. The anchor portion has a limited number of structures to which it can attach. The straps often become tangled. The number and types of exercises that can be performed is limited.

SUMMARY

The systems, methods and devices described herein have innovative aspects, no single one of which is indispensable or solely responsible for their desirable attributes. Without limiting the scope of the claims, some of the advantageous features will now be summarized.

BRIEF DESCRIPTION OF THE DRAWINGS

The above-mentioned aspects, as well as other features, aspects, and advantages of the present technology will now be described in connection with various embodiments, with reference to the accompanying drawings. The illustrated embodiments, however, are merely examples and are not intended to be limiting. Like reference numbers and designations in the various drawings indicate like elements. Not all of the elements of the drawings are in to scale relate to other drawings and the comparative size of one element relative to another element in the drawings is not necessarily indicative of the relative sizes of the elements in one or more embodiments.

FIG. 7B illustrates a top view of an embodiment of at least a lower strap and a spring.

DETAILED DESCRIPTION

Figure 1:
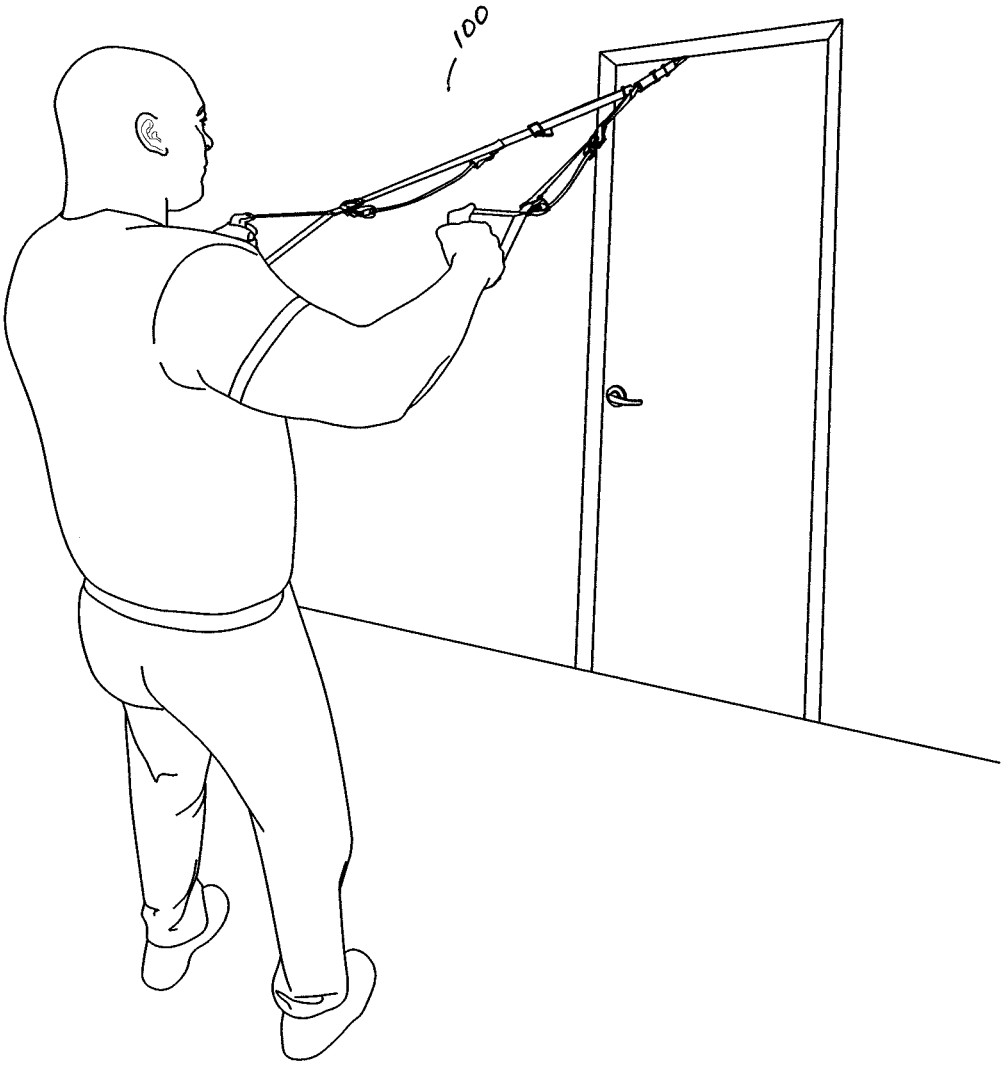
FIG. 1 illustrates a perspective view of an embodiment of the invention.

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and faun part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Elements that are described as "connected," "engaged," "attached," or similarly described, shall include being directly and/or indirectly connected, engaged, attached, etc. Alterations and further modifications of the inventive features illustrated herein, and additional applications of the principles of the inventions as illustrated herein, which would occur to one skilled in the art and having possession of this disclosure, are to be considered within the scope of the invention.

Descriptions of unnecessary parts or elements may be omitted for clarity and conciseness, and like reference numerals refer to like elements throughout. In the drawings, the size and thickness of layers and regions may be exaggerated for clarity and convenience.

Features of the present disclosure will become more fully apparent from the following description and appended claims, taken in conjunction with the accompanying drawings. It will be understood these drawings depict only certain embodiments in accordance with the disclosure and, therefore, are not to be considered limiting of its scope; the disclosure will be described with additional specificity and detail through use of the accompanying drawings. An apparatus, system or method according to some of the described embodiments can have several aspects, no single one of which necessarily is solely responsible for the desirable attributes of the apparatus, system or method. After considering this discussion, and particularly after reading the section entitled "Detailed Description" one will understand how illustrated features serve to explain certain principles of the present disclosure.

As shown in FIG. 1, the exercise device 100 may comprise various buckles, connectors, straps, springs, etc. The various buckles, connectors, straps, springs, etc. may be configured to allow the user to connect, disconnect, and/or reconnect various parts of the device depending on the desired use of the device. In some embodiments, a first end of the exercise device 100 comprises an anchor portion 200. The anchor portion 200 may comprise straps, stitching, buckles, connectors, and/or an obstruction device. The anchor portion 200 is proximate an upper strap 250. The upper strap 250 is proximate a connector 300. The connector 300 is proximate at least one elongate strap 400. The at least one elongate strap 400 is proximate a lower strap 450 and a spring 500. The lower strap 450 and spring 500 are proximate at least one handle 550.

Figure 2:
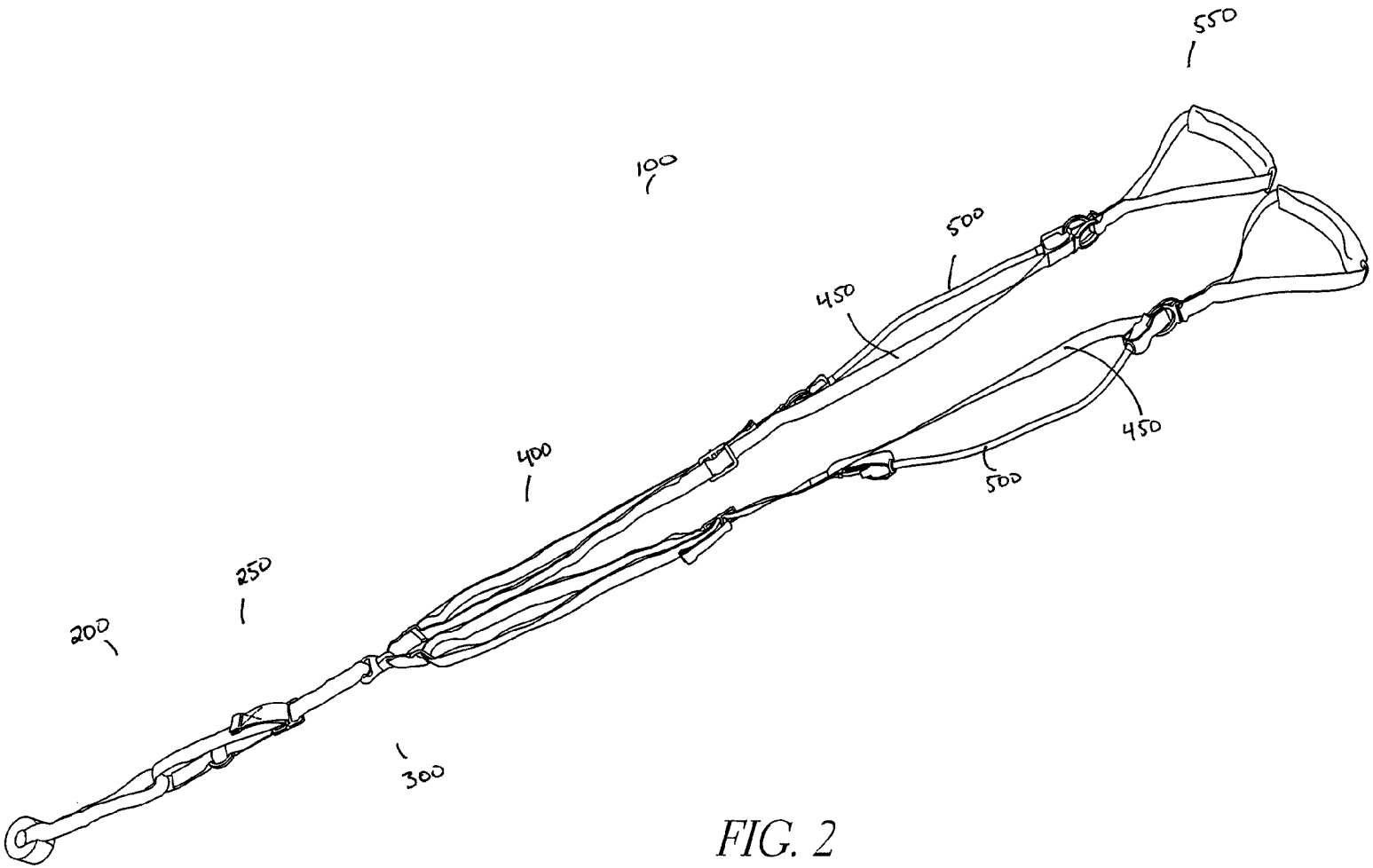
FIG. 2 illustrates a top view of an embodiment of the invention.

As shown in FIG. 2, the anchor portion 200 of an exercise device 100 may be attached to or engaged with a stable structure; a user may grip or otherwise engage a second end of the device 100, which may comprise one or more handles 550. The stable structure may provide a point from which the exercise device 100 can be extended. It may be advantageous for the structure, to which the device 100 is attached; to be capable of preventing or reducing movement of at least part of the exercise device 100, even when a force is applied to the device 100 in a direction away from the structure. Various exercises may be performed by the user by engaging the device 100 and then performing movements. The orientation of the user relative to the device 100 and the direction of the user's movements may vary depending on the preferences of the user.

Figure 3:
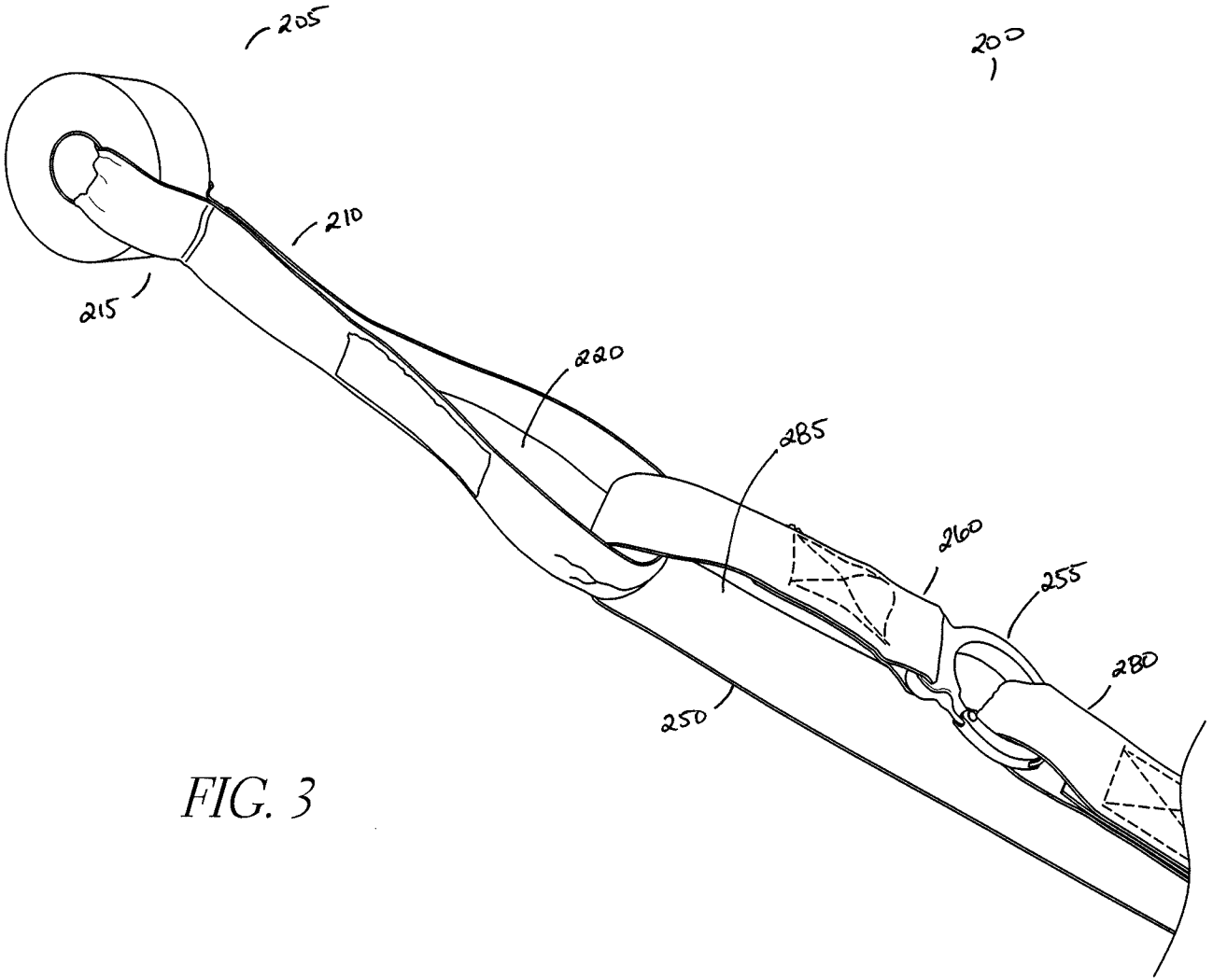
FIG. 3 illustrates a top view of an embodiment of at least an anchor portion.

As shown in FIG. 3, the anchor portion 200 may comprise an obstruction device 205 and an anchor strap 210. The obstruction device 205 may comprise various shapes and may be several inches wide and high. In some embodiments, the obstruction device 205 is a cylindrical section of foam with a harder plastic core. The core defines a hole through which the anchor strap 210 may be disposed. In other embodiments, the obstruction device 205 may be other three-dimensional shapes, or may more closely resemble a flat plate. In other embodiments, the obstruction device 205 may be a pipe, tube, plate, sphere, or other shape, and may comprise a protective layer on at least part of the surface of the obstruction device. In the embodiments where the obstruction device 205 is shaped like a flat plate, the anchor strap 210 may be threaded through one or more holes in the plate. The obstruction device 205 may comprise foam, plastic, PVC, or other material. In some embodiments, the obstruction device 205 may comprise a PVC pipe that is at least partially covered, and may be wrapped in a nylon strap. The nylon strap may comprise a loop or other connector at one end of the obstruction device 205, in order to engage other portions of the exercise device 100. It may be advantageous for the obstruction device 205 to comprise a material that does not leave a mark or residue when rubbed against a surface. In some embodiments, it may also be advantageous for the obstruction device 205 to be generally lightweight, in total weight or in density. The obstruction device 205 may be between 0.5 inches and 5 inches wide; or it may be between 1 inch and 3 inches wide, or it may be approximately 2 inches wide. Dimensions for the height of the obstruction device 205 may be similar to those of the width, however the scope of the invention is not limited by the relative or absolute dimensions of the obstruction device 205.

The anchor strap 210 may be disposed within at least part of the obstruction device 205, or may otherwise be attached or attachable to the obstruction device 205. In some embodiments, the anchor strap 210 comprises nylon webbing, which may be approximately 1 inch in width. The anchor strap 210 may be wider or narrower and still provide the same function or benefits. The anchor straps 210 on either side of the obstruction device may be sewn or attached to each other to create a loop 215 onto which the obstruction device 205 may be disposed. The anchor strap 210 may comprise a second loop 220 that may engage or attach to, directly or indirectly, at least a portion of the upper strap 250. In some embodiments, the upper strap 250 may be disposed in a loop 220 created by the anchor strap 210, or the upper strap 250 may engage a connector, which in turn engages the anchor strap 210.

Figure 4:
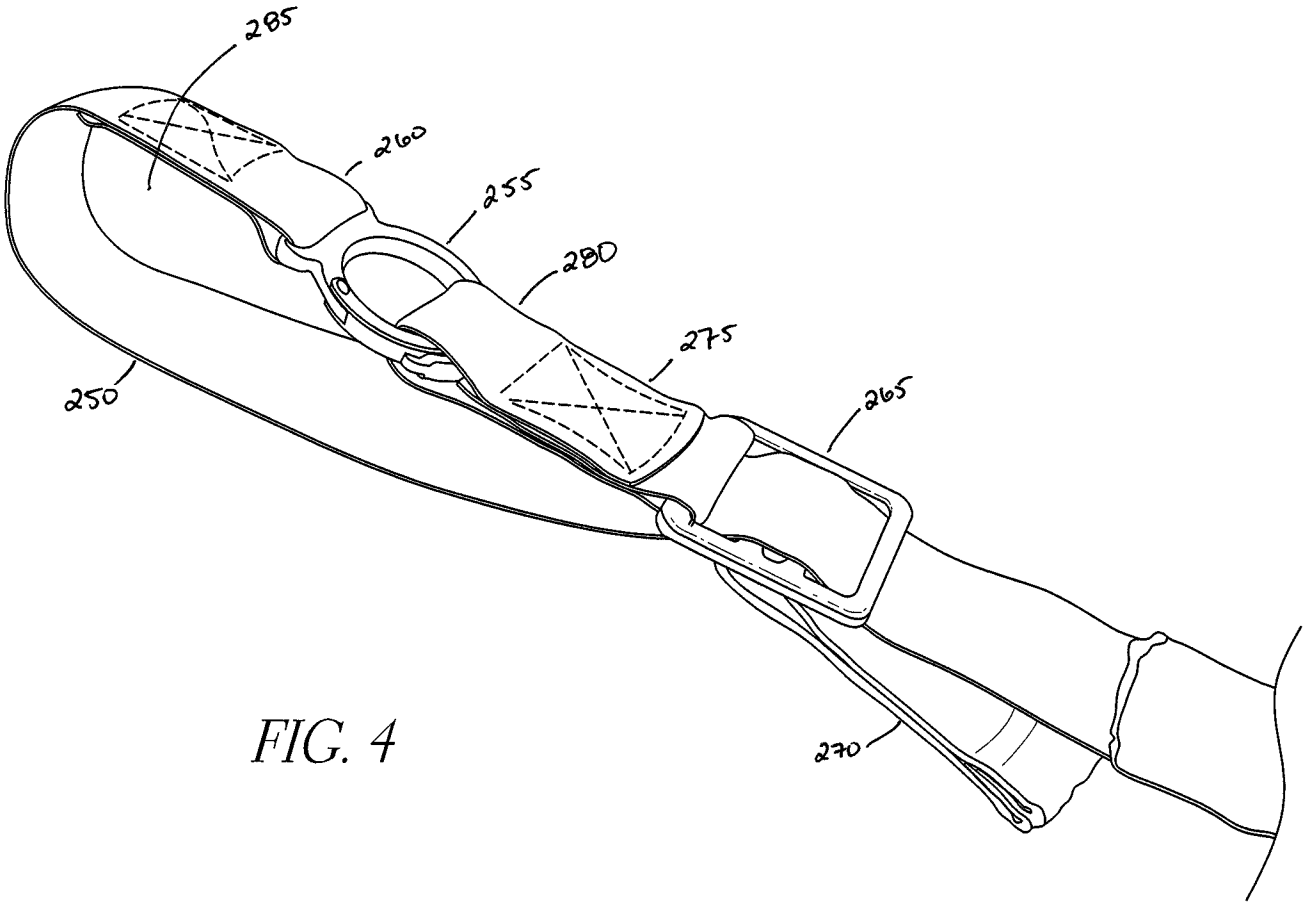
FIG. 4 illustrates a top view of an embodiment of at least an upper strap.

As shown in FIG. 4, the upper strap 250 may be connected to an upper strap connector 255 and/or an upper strap adjuster 265. The upper strap connector 255 may be disposed at a first end of the upper strap 250 and may be temporarily or permanently attached to the upper strap 250. The upper strap 250 may comprise nylon webbing, which may be approximately 1 inch in width. The upper strap 250 may be wider or narrower and still provide the same function or benefits. In some embodiments, the upper strap 250 is sewn to create a loop 260, onto which the upper strap connector 255 may be disposed.

The upper strap 250 may engage an upper strap adjuster 265, which may comprise a ladder lock buckle. In some embodiments, the upper strap 250 is disposed in one or more openings in the adjuster 265 such that the adjuster 265 may slide or move along at least part of the upper strap 250. An adjuster grip 270 may be connected to the upper strap adjuster 265 and may allow a user to more easily adjust the location of the adjuster 265 along the upper strap 250. A second strap 275 may be attached to the adjuster 265 and may be sewn to create a loop 280. The loop 280 may be configured to engage at least a part of the upper strap connector 255. When the loop 280 is engaged with the upper strap connector 255, a larger loop 285, largely defined by the upper strap 250, may be created. The size of the larger loop 285 may be adjusted by sliding the adjuster 265 along the upper strap 250. The adjuster 265 may be moved before or after the larger loop 285 is created.

The upper strap connector 255 may comprise a buckle, carabineer, or other connector that may temporarily connect together one or more portions of straps. In some embodiments, the upper strap connector 255 is a carabineer with an opening on the side through which a strap may be passed. In some embodiments, the connector 255 may be a buckle wherein a female portion of the buckle is disposed on the end of the upper strap and a male portion of the buckle is disposed on the second strap, or vice versa. The male portion may engage the female portion of the buckle to create a larger loop 285. Other methods of directly or indirectly connecting the upper strap 250 to the second strap 275 may be employed and the scope of the invention is not limited by the configuration of such a connection. The adjuster 265 may comprise plastic or metal or other material. Other methods of adjusting the size of the larger loop 285 may be employed.

Figure 5:
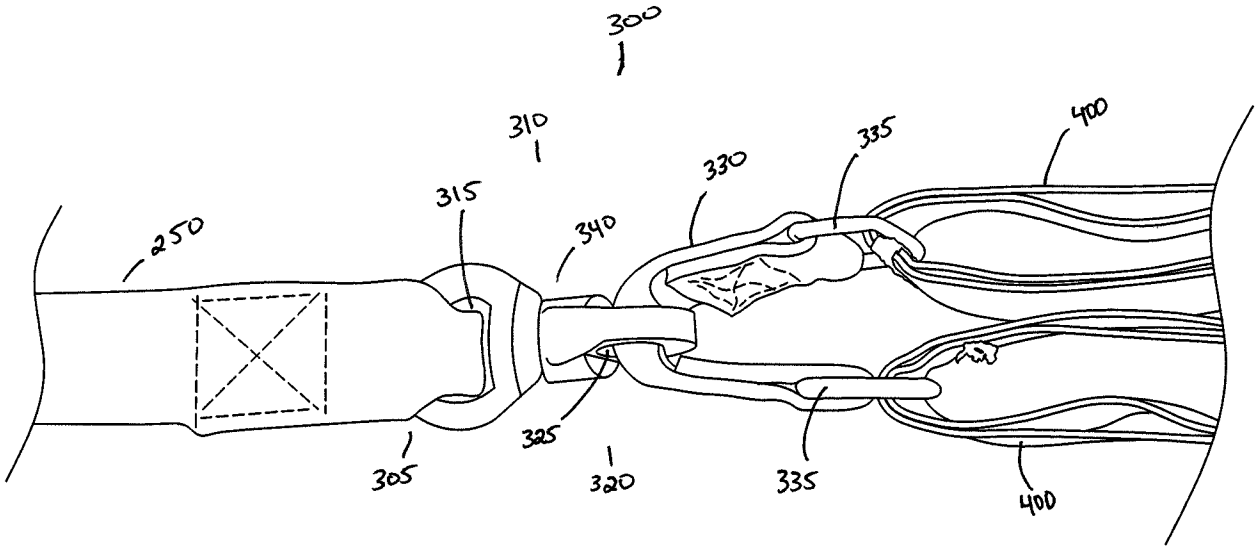
FIG. 5 illustrates a top view of an embodiment of at least a connector.

As shown in FIG. 5, the upper strap 250 may be attached to a main connector 300. In some embodiments, an end of the upper strap 250 may be configured to create a loop 305, which engages a first end 310 of the main connector 300. The first end 310 may comprise an eyelet 315 through which the end of the upper strap 205 may be disposed. In some embodiments, a portion of the upper strap 250 other than the end may engage the main connector. In some embodiments, the anchor portion 200 may comprise the components adjacent the main connector 300 up to an including the obstruction device 205.

The main connector 300 may also comprise a second end 320, which may also comprise an eyelet 325. The eyelet of the second end 325 may be configured to engage an eyelet strap 330, which may comprise one or more eyelet connectors 335. In some embodiments, each of the one or more eyelet connectors 335 engages one or more elongate straps 400. In some embodiments, the eyelet strap 330 engages two eyelet strap connectors 335, each of which engages an elongate strap 400. In some embodiments, the one or more elongate straps 400 may engage the second end of the main connector 320 directly or indirectly. The main connector 300 may be configured such that the elongate straps 400 are disposed through eyelet strap connectors 335, or through the eyelet of the second end 325.

In some embodiments, the main connector 300 comprises a swivel portion 340, wherein the first end of the main connector 310 is capable of rotating relative to the second end 320. The first end 310 may be configured to be able to rotate less than 360 degrees relative to the second end 320, or may be configured to rotate 360 degrees or more relative to the second end 320. In some embodiments, the first end 310 is configured to not substantially move longitudinally away from the second end 320, and may be capable of withstanding significant longitudinal tensile force without substantial longitudinal movement.

An exercise device 100 that comprises a main connector 300 with a swivel portion 340 may be beneficial to a user of the exercise device 100. For instance, the user may be able to perform different exercises because the swivel portion 340 prevents the one or more elongate straps 400 from becoming tangled. As a non-limiting example, a user may perform an exercise that twists or rotates the exercise device 100. When rotating, the first elongate strap 400 may become tangled with the second elongate strap 400 or catch on the second elongate strap 400. However, by using a swivel portion 340 of the main connector 300, the first and second elongate straps 400 may rotate relative to the anchor portion 200 and the first and second elongate straps 400 may remain in substantially the same position relative to each other, even during a twisting motion.

As a second non-limiting example, the swivel portion 340 may allow the a first elongate strap 400 to remain at a constant angle relative to a second elongate strap 400 during exercise motions in which the exercise device 100 is rotated or twisted. For instance, an exercise to be performed with the exercise device 100 may comprise applying a tensile force to the handles 550 in a direction away from the anchor portion 200. The first and second elongate straps 400 (connected to the first and second handles 550 respectively) may be at a specific orientation to one another. The user may benefit from the elongate straps 400 being at a certain angle, where the angle is defined by the first handle 550, to the main connector 300, then to the second handle 550. An exercise may be performed wherein the user twists or rotates the handles 550 around an axis that is in generally parallel to the tensile force applied to the anchor portion 200. In such a configuration, without a swivel portion of the main connector 340, the elongate straps 400 may have a tendency to wrap about one another, effectively shortening their length. If the user keeps his hands at a constant distance apart, the angle from the first handle 550, to the main connector 300, to the second handle 550, will increase in magnitude. However, if a swivel portion of the main connector 340 is present, the elongate straps 400 may be able to freely rotate about the axis, such that the elongate straps 400 do not become twisted, which may allow the angle to remain unchanged. It may be important for different exercises for the angle between the elongate straps 400 to remain constant and to not change throughout the motion of the exercise.

In addition, in some embodiments, it may be easier for the user to arrange the exercise device 100 for use if a swivel portion 340 is present. For example, if the user attaches the anchor portion 200 to a suitable structure, the exercise device 100 may be twisted from storage, and may not be in a condition for use without untwisting. However, if the exercise device 100 comprises a main connector 300 comprising a swivel portion 340, the user may be able to grab the handles 550 and begin use immediately, since any tensile force applied an the exercise device 100 that is twisted, may have the tendency to untwist the anchor portion 200 relative to the elongate straps 400 by rotating at least part of the swivel portion of the main connector 340. This may save the user time and reduce frustration.

Figure 6:
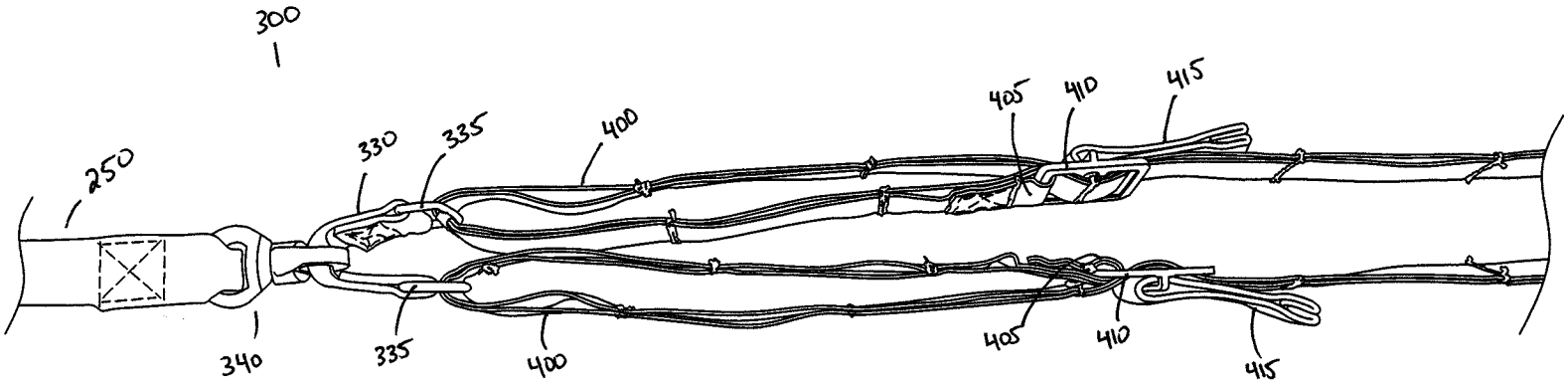
FIG. 6 illustrates a top view of an embodiment of at least an elongate strap.

As shown in FIG. 6, the elongate straps 400 may be connected, directly or indirectly, to a portion of the main connector 300. In some embodiments, the main connector 300 attaches to two elongate straps 400. Each elongate strap 400 may comprise two pieces of nylon webbing, which may be approximately 1 inch in width. The elongate straps 400 may be wider or narrower and still provide the same function or benefits. The elongate straps 400 may be several feet in length. For each elongate strap 400, the two pieces of webbing may be attached to each other at regular intervals. The intervals between the stitching may be between 0.5 inches and 12 inches, between 2 inches and 8 inches, or may be approximately 5 inches. The stitching may also be irregularly spaced, with some intervals being larger than others.

In some embodiments, an end of an elongate strap 400 comprises a loop 405, which is connected to an adjuster 410. The adjuster 410 may comprise a ladder lock buckle. The adjuster 410 may be configured to slide or move along at least part of the elongate strap 400, and may comprise an adjuster grip 415 that may make it easier for the user to adjust the position of the adjuster 410 long the strap 400. Another end of the elongate strap 400 may be connected to a lower strap 450 or to a spring 500. The distance between the lower strap 450 and the main connector 300 may be changed by altering the position of the adjuster 410 along the elongate strap 400. As a non-limiting example, if the adjuster 410 is moved closer to the main connector 300, the distance between the main connector 300 and the lower strap 450 may be increased. If the adjuster 410 is moved closer to the lower strap 450, the distance between the main connector 300 and the lower strap 450 may be decreased. This may be true for both elongate straps 400 on the exercise device. In some embodiments, moving the adjuster 410 closer to the main connector 300 may decrease the distance between the main connector 300 and the lower strap 450, and may depend on the specific configuration of the connectors, straps, and adjusters. By sliding the adjusters 410 to different positions along the elongate straps 400, the user may be able to change the total length of the exercise device 100, including the distance between the anchor portion 200 and the handles 550. This may be advantageous in that different exercises may benefit from the exercise device 100 being different lengths. An embodiment that uses adjusters 410 that slide along the elongate straps 400 to adjust its length may be advantageous because they may allow the user to quickly change the length of the exercise device 100 between different exercises and may prevent the user from having to take excessive time between exercises to make adjustments to the equipment.

Figure 7A:
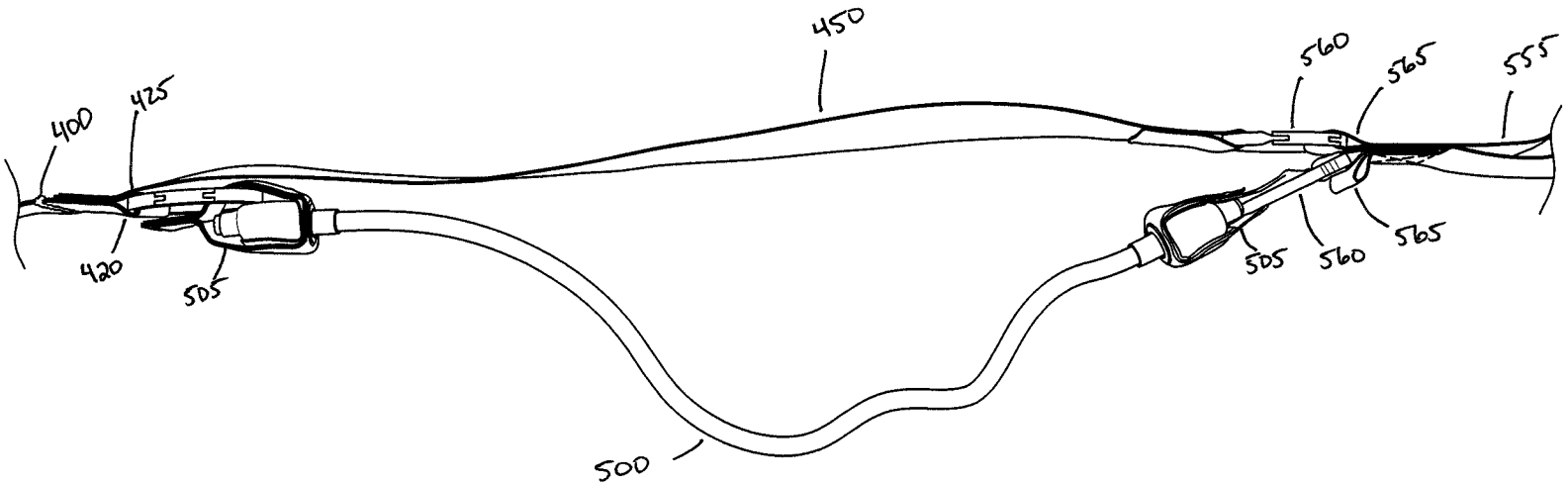
FIG. 7A illustrates a top view of an embodiment of at least a lower strap and a spring.

As shown in FIG. 7A, an end of the elongate strap 400 may be connected to a lower strap 450 and/or a spring 500. The elongate strap 400 may attach to a connector 420, which may be attached to one end of a spring 500. The second end of the lower strap 450, and the second end of the spring 500, may both connect to a handle strap 555. The lower strap 450 may attach to a connector 560, which may be attached to the handle strap 555. The spring 500 may be attached to a connector 560, which may be attached to the handle strap 555.

The lower strap 450 may comprise nylon webbing, which may be approximately 1 inch in width. The lower strap 450 may be wider or narrower and still provide the same function and benefits. In some embodiments, the lower strap 450 is attached directly to the elongate strap 400 via stitching. Or, the lower strap 450 may attach to a connector 420, which may attach to the elongate strap 400. The elongate strap 400 may comprise a loop 425, through which a connector 420 may be disposed. The connector 420 may be attached to a first end of a spring 500. The spring 500 may be a tubular or cylindrical spring band, or may have another shape such as a flat band, commonly used for exercising. Springs designed for exercise may be used, or springs designed for other purposes may be utilized. In some embodiments, the first end of the spring 500 may comprise a webbing loop 505 that engages the connector 420 to secure the end of the spring 500 to the connector 420 and to the end of the elongate strap 400.

In some embodiments, the handle strap 555 comprises at least one loop 565, and may comprise two, three, or more loops 565. Each loop 565 may be configured to receive a connector 560. A connector 560 attached to the handle strap 555 may be configured to be attached to the lower strap 450, to the spring 500, to both the lower strap 450 and the spring 500, or to another component of the exercise device 100.

Figure 7C:
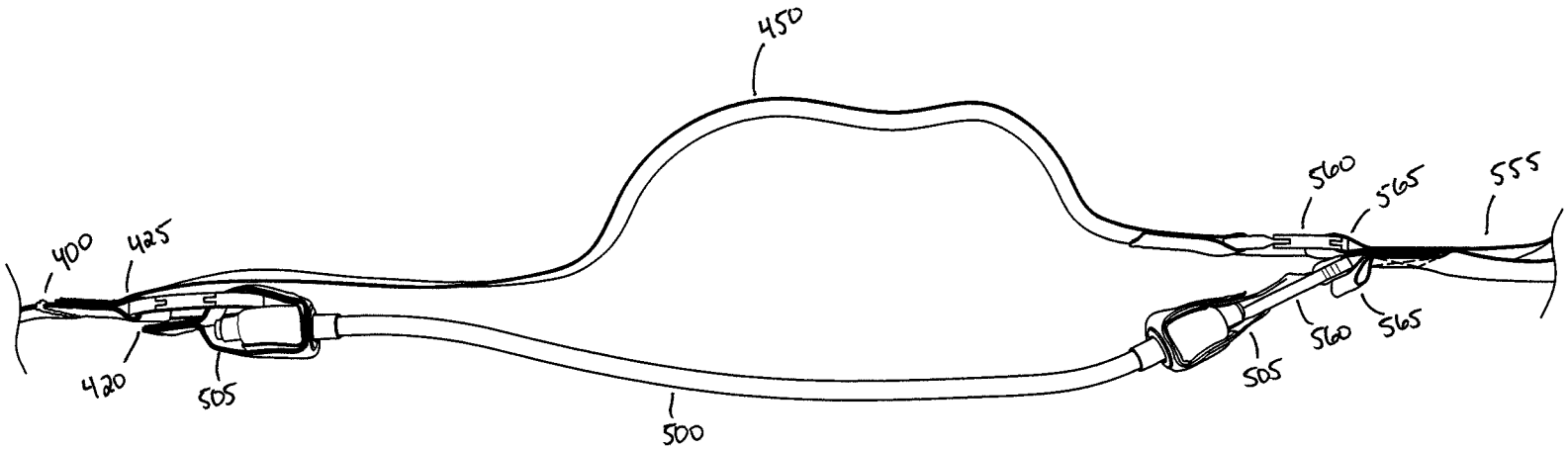
FIG. 7C illustrates a top view of an embodiment of at least a lower strap and a spring.

As depicted in FIG. 7A, the lower strap 450 may be shorter than the spring 500. As depicted in FIG. 7B, the lower strap 450 may be generally the same length as the spring 500. As depicted in FIG. 7C, the lower strap 450 may be longer than the spring 500.

Figure 8:
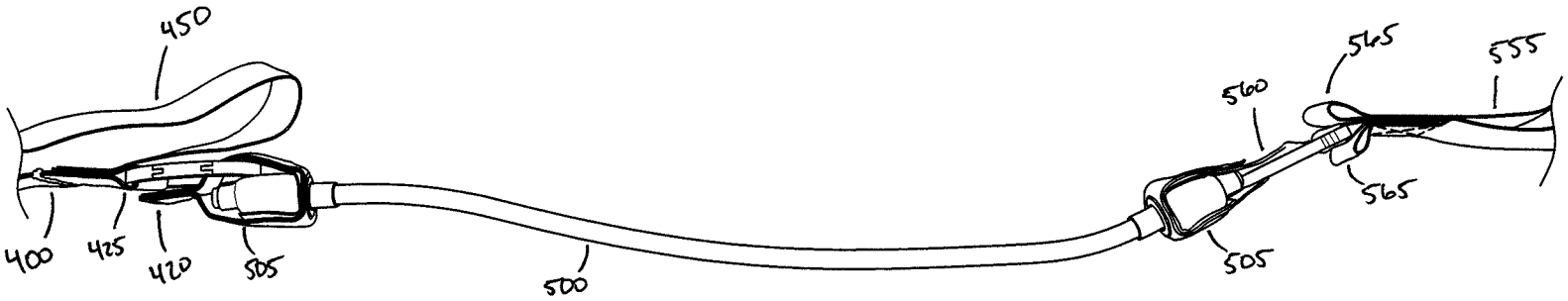
FIG. 8 illustrates a top view of an embodiment of at least a spring.

As shown in FIG. 8, the lower strap 450 may be detached from the handle strap 555. In some embodiments, the lower strap 450 is detachable from the handle strap 555 and may be attached to another portion of the exercise device 100. The end of the lower strap 450 may remain attached to the connector 560, and then once the connector 560 is detached from the handle strap 555, the connector 560 may be attached to a portion of the elongate strap 400. The connector 560 may be configured to attach to the space between the two pieces of webbing of the elongate strap 400. The stitching connecting the two pieces of webbing may be configured to keep the connector 560 from detaching or from sliding excessively along the elongate strap 400. In some embodiments, once the lower strap 450 has been detached from the handle strap 555, only the spring 500 is left connecting the elongate strap 400 to the handle strap 555. Thus, the distance between the elongate strap 400 and the handle 550 may be variable depending on the amount of force applied to the handle 550. In some embodiments (not shown) more than one spring 500 may connect the elongate strap 400 to the handle 550. Each spring 500 may have the same or different spring constant.

Figure 9A:
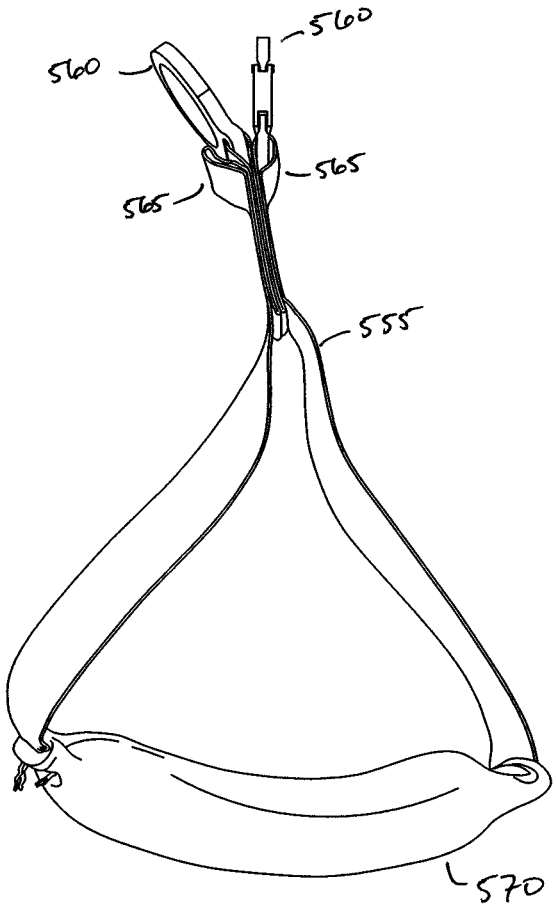
FIG. 9A illustrates a top view of an embodiment of at least a handle.
Figure 9B:
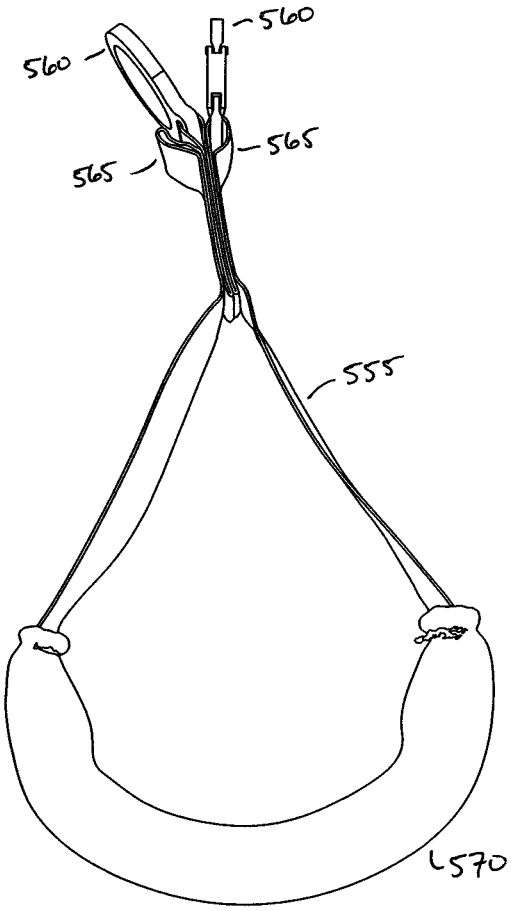
FIG. 9B illustrates a top view of an embodiment of at least a handle.

As shown in FIG. 9A, the handle strap 555 may comprise one or more loops 565 that can accommodate one or more connectors 560. The handle strap 555 may also attach to a grip portion 570. In some embodiments, the grip portion 570 comprises a generally rigid core and a softer outside. The core may allow the grip portion 570 to be configured in a specific shape and may allow the grip portion 570 to remain in that shape. The softer outside may be advantageous as it may allow the user to more securely engage the grip 570. The shape of the grip portion 570 may be variable and different configurations may be more advantageous for different exercises. For instance, the configuration of the grip portion 570 depicted in FIG. 9B may be easier for some users to grab onto or otherwise engage.

In some embodiments, the handles may be configured to engage one or more parts of the user's body. For instance, as a non-limiting example, the handle may be sized to accommodate a user's hand, foot, ankle, elbow, wrist, knee, or other part of the user's body. The handle may be configured to allow the user to easily insert his foot and/or ankle into the handle portion. This may be advantageous because the user may be able to perform more exercises. This may also be an improvement over conventional portable exercise devices because often these exercise devices do not have handles that are sized to accommodate different parts of the user's body. In some embodiments, the handle may be configured to accommodate two or more parts of a user's body at the same time.

In some embodiments, to use the exercise device 100, the user first anchors a portion of the exercise device to a stable structure. The stable structure may include the top of a door frame, the side of a door frame, the bottom of a door, a horizontal pole, a vertical pole, or some other stationary object (e.g., door handle, bed post, etc.). The device may be anchored in a door frame by first starting with the door open. The user may place the obstruction device 205 on the far side of the door with the anchor strap 210 disposed between the door and the door frame. The door may then be closed. When tension is applied to the exercise device 100, the anchor strap 210 pulls on the obstruction device 205. Because the obstruction device 205 is on the far side of the door and cannot easily fit through the space between the door and the door frame, the exercise device 100 does not move easily and is substantially prevented from moving away from the door. The same procedure may be used when the exercise device 100 is to be anchored to the top of the door frame, to the side of the door frame, or at the bottom of the door between the door and the floor.

In some embodiments, the exercise device 100 may be anchored to a stable object other than a door and/or door frame. For instance, the exercise device 100 may be anchored to a pole, bar, tree, or some other stable object around which a strap may be placed. For these objects, there may not be a convenient place into which the obstruction device 205 may be placed. Instead, the upper strap 250 may be wrapped around the stable object. For instance, in order to anchor the exercise device 100 to a horizontal bar, a tree branch, or similar stable structure, the upper strap 250 and upper strap connector 255 may be disconnected from the second strap 275. The upper strap 250 may then be wrapped around the stable object and then reconnected to the second strap 275, wherein the upper strap 250 and second strap 275 create a loop 285 and the stable object is disposed within the loop 285. The upper strap adjuster 265 may then be positioned along the upper strap 250 to shorten the size of the loop 285 such that the upper strap 250 fits snuggly against the stable structure.

Conventional exercise devices may contain a mechanism to attach to a stable structure such as a horizontal bar, and may contain the equivalent of an upper strap 250. However, the attachment mechanism that is used to create the loop 285, into which the stable structure is disposed, is often very different. In conventional devices, the upper strap has a finite number of discrete attachment points, creating a limited number of sizes of loops that can be created. In order to attach such a device to a horizontal bar, the user must use the next largest loop, which will undoubtedly have unnecessary and unwanted slack. However, in some embodiments, the exercise device 100 has an unlimited number of sizes of loops 285 that can be created due to the fact that the upper strap adjuster 265 can continuously slide along the length of the upper strap 250. Additionally, as described above, the upper strap 250 can be positioned around the stable object and then reconnected, and then the size of the loop 285 is adjusted. Being able to adjust the size of the loop 285 after the stable object has been disposed within the loop 285 is advantageous because it allows the user to create a more stable connection between the upper strap 250 and the stable object.

When the exercise device is attached to a horizontal bar, the differences between the exercise device and conventional exercise devices may not be as apparent. However, when attaching the exercise device to a vertical pole (e.g., a bed post, tree trunk, etc.), the differences may become more important. Since the straps from a conventional exercise device cannot be snugged up against the pole, the device may have a tendency to fall down when tension is not applied to the device. Contrastingly, when the upper strap 250 of the exercise device 100 is snugged up against the vertical pole, being adjusted after the loop 285 has been created, the ability of the exercise device 100 to maintain its position on the vertical pole improves, even when tension is not applied. This is true not just for vertical poles, but also for other objects as well. For instance, a user may desire to attach the exercise device 100 to a door knob. Conventional exercise devices will have a tough time adequately securing a strap to a door knob, since the conventional exercise device has a limited number of loop sizes, and the loop cannot be decreased once the loop is created. Conversely, the upper strap 250 of the exercise device 100 may wrapped around a door knob, the upper strap connector 255 can then attach to the second strap 275 creating a loop 285, and then the upper strap adjuster 265 can be positioned along the upper strap 250 to decrease the size of the loop 285 in order to securely fit the upper strap 250 to the door knob.

Once the exercise device 100 has been secured to a stable object, the user may perform a variety of exercises. In some embodiments, the user may grasp the handles 550 with his hands and exert a force on the handle 550 in the direction opposite of the stable object. The user may push the handles 550 away from the stable object, pull the handles 550 away from the stable object, he may rotate at least part of his body to exert a force on the handles 550 in the direction away from the stable object, or he may perform a different motion that exerts a force on the exercise device 100 away from the stable object. The user may exert a force on a single handle 550 using a single hand, he may exert a force on a single handle 550 using both hands, he may exert a force on both handles 550 using a single hand, or he may exert a force on both handles 550 using both hands. Other combinations may be possible. In some embodiments, the user may engage a different part of his body with the handles 550 in order to exert a force on the handles 550 in a direction away from the stable object. For instance, as non-limiting examples, the user may engage one or more handles 550 with the user's elbows, ankles, heels, tops of feet, bottoms of feet, shins, backs of knees, or some other body part. Different exercises may benefit from different body parts being used to engage one or more handles 550.

In some embodiments, to use the exercise device 100, the user may use a part of his body to exert a tensile force on the exercise device 100 in a direction away from the stable object. For instance, as a non-limiting example, the user may use the exercise device 100 to perform an exercise similar to a lat row. To perform this exercise, the user may begin with the exercise device 100 anchored to a stable object, such as the top or side of a door frame, so that the height of the anchor portion 200 above the ground is similar to the height of the user's chest above the ground. The user then grips the handles 550, one hand per handle 550, faces the door frame, and places his hands close to his chest. The user may then step back until the exercise device 100 is generally taught and fully extended. The user then begins the exercise movement by extending his arms and simultaneously leaning back so that the exercise device 100 remains fully extended. Then, the user may pull his hands back towards his chest, resulting in his body moving forward towards the door frame. This exercise may work out the muscles in the user's upper back.

In some embodiments, the user may be able to perform an exercise similar to a chest press. To perform this exercise, the user begins with the exercise device 100 in the same position, but instead begins with his back towards the door frame and his arms stretched out in front of himself. Then, to begin the exercise, the user leans forward and allows his hands to come close to his chest. Then, the user pushes his hands away from his chest, resulting in his body being pushed back into an upright position. This exercise may work out the muscles in the user's chest.

Either of these two example exercises may be performed by either conventional devices or with an exercise device 100 wherein the elongate strap 400 is connected to the handle 550 by the lower strap 450. However, the exercise could be improved if the lower strap 450 is detached from the handle 550 and attached to a point on the elongate strap 400 (see FIG. 8), with only the spring 500 connecting the elongate strap 400 to the handle 550. In such a configuration, the user may be able to perform the exercise without having to rely on his own body weight for resistance, and would not have to tilt his whole body in the process. Instead, the user can begin the lat row exercise facing the door frame with his arms extended and the exercise device 100 in a fully extended position. The user then pulls his hands towards his chest. Because the spring 500 connects the elongate strap 400 to the handle 550, and the lower strap 450 does not connect the elongate strap 400 to the handle 550, the handle 550 may move away from the door frame when a tensile force is applied to the exercise device 100. Since a spring 500 is providing the resistance to the user's pulling motion, the more force that is applied, the further the handles 550 can be moved away from the door frame. In this exercise, the user's body may remain in an upright position and may facilitate a better posture for the exercise motion.

Similar advantages may be found performing the chest press exercise using a spring 500 as resistance. For instance, the user may begin with his back to the door frame, exercise device 100 fully extended, and hands near his chest. The user may then extend his arms forward away from the door frame, exerting a tensile force on the exercise device 100, and using the spring 500 as resistance to his movement. Once the user extends his arms fully, or as far as he desires, the user can then bring his hands back to his chest. Similar to the lat row exercise, the user can perform this exercise without having to tilt and move his upper body and does not need to rely on his own body weight for resistance. This configuration is advantageous in that the user can focus more on specific muscles and can achieve a better posture for the exercise movement. Using an exercise device that comprises springs instead of solely the user's body weight for resistance, may also allow the user to perform exercises in a more comfortable or ergonomic position. For instance, when using an exercise device that comprises straps but no springs, the user's feet are generally placed parallel together in the user's body must tilt forwards or backwards. This may require the user to keep his core tight prevent his hips from dropping to avoid any injuries to his lower back. However, when using an exercise device that comprises springs, the user may be able to place one foot ahead of the other foot, resulting in a more stable stance. In this stance, the user's hips may no longer drop and may not put pressure on the user's lower back.

Although two exercises were described that could be performed with conventional exercise devices, and performed better using one or more embodiments of the current exercise device 100, there are other exercises that are not possible with conventional exercise devices because the range and direction of movement does not rely on the user's body weight. For instance, as a non-limiting example, the user may anchor the exercise device 100 to the bottom of a door. The user may perform an exercise similar to a shoulder row. Here, the user begins with his hands near his waist and the exercise device 100 fully extended. Note that the length of the exercise device 100 may need to be adjusted, and may be accomplished by moving the adjuster 410 along the elongate strap 400. For this exercise, the user may prefer to have the lower strap 450 be disconnected from the handle portion 550 so that only the spring 500 connects the elongate strap 400 to the lower strap 450. To begin the exercise, the user pulls up on the handles 550, exerting a tensile force on the exercise device 100, until his hand are near his shoulders or chin. Because the spring 500 provides resistance to the user's movement, the handles 550 will generally be more difficult to pull up on as the user's hands get closer to his shoulders or chin. The user may then lower his hands back down towards his waist, decreasing the tensile force on the exercise device 100. Since this exercise is performed with the user pulling up on the handles 550, it is not possible to perform a similar exercise on a conventional exercise device that relies only on the user's body weight for resistance. Thus, one or more embodiments of the exercise device 100 that use springs 500 for resistance may be advantageous because it allows the user to perform more exercises using the same equipment.

In some embodiments, another exercise that cannot be performed using a conventional device is an exercise similar to a standing hip abductor exercise. Here, the user begins by anchoring the device 100 at or near the bottom of a door, or other stable structure at approximately the same height. For instance, a bed post or desk leg may suffice. The user may then engage his foot with the handle 550 and move his ankle away from the stable structure until the there is no slack in the exercise device 100. The user may the stand and face in a direction, such that the ankle in the handle 550 is furthest from the stable structure and the ankle not in the handle 550 is closest to the stable structure. The user may lift the ankle in the handle 550 a few inches off of the floor and gently move it away from the stable structure, and then return the ankle to the starting position. This exercise motion moves the handle 550 of the exercise device 100 in a generally horizontal direction and the resistance to the movement is not dependent on the user's own weight. Instead, the resistance to the movement is provided by stretching the spring 100. Thus, this exercise is not possible with a conventional exercise device that only relies on the user's own weight for resistance to movement. The configuration of an embodiment of the exercise device 100 that uses springs 550 for resistance may be advantageous because it allows the user to perform more exercises using the same equipment.

In some embodiments, a spring 500 connects the elongate strap 400 to the handle strap 555. The springs 500 may comprise a spring constant, wherein the spring constant is in the form of force/displacement. Common units for spring constants may be N/m or lbf/ft.

In some embodiments, more than one spring 500 connects the elongate strap 400 to the handle strap 555. When two springs are in a parallel configuration, their spring constants are additive. Two springs in parallel, with the same spring constants and the same lengths, will have approximately twice the resistance of a single spring in the same setting. In some embodiments, the exercise device 100 has a connector at the end of the elongate strap 420 and a connector 560 at the end of the handle strap 555. More than one spring 500 may be attached to the exercise device 100 at the same time. The springs 500 may be of different lengths and of different spring constants.

For embodiments of an exercise device 100 that comprises two springs 500 (of the same spring constant and length) disposed between an elongate strap 400 and a handle strap 555, the exercise device 100 may provide approximately twice the resistance as would embodiments where only a single spring 500 was disposed between an elongate strap 400 and a handle strap 555. It may be advantageous for the user to have the ability to easily increase the resistance of the exercise device 100 by simply adding or taking away springs 500. In some embodiments, two springs 500 may be attached, wherein the springs 500 have the same length, but different spring constants. The resulting spring constant of the two springs 500 together may be greater than either spring independently, and the magnitude of the resulting spring constant will depend, at least, on the values of the spring constants of the springs 500 attached to the exercise device 100.

Figure 11:
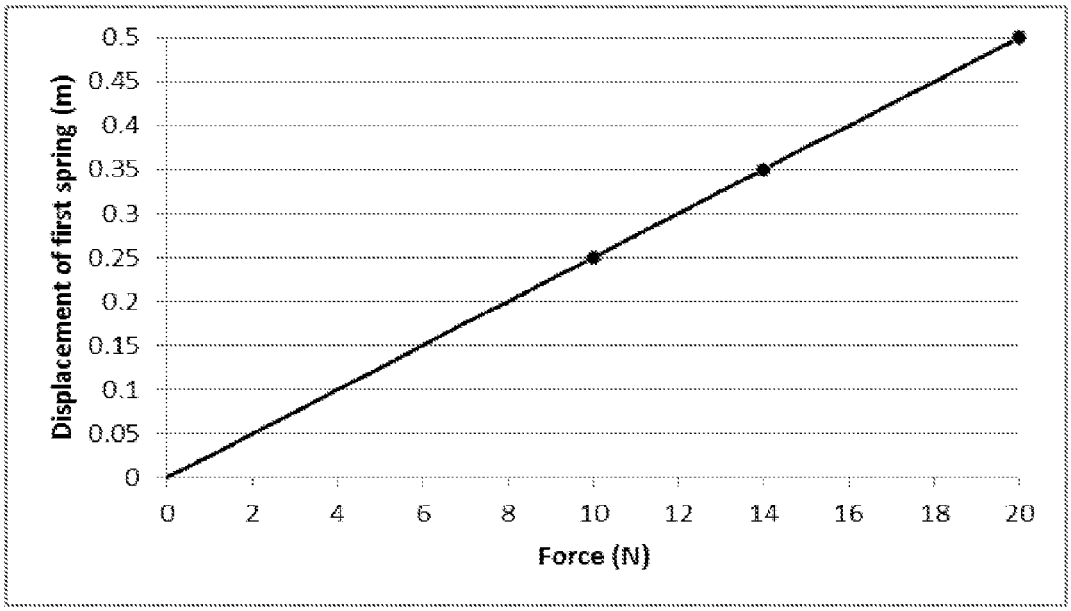
FIG. 11 illustrates a first force/displacement chart.

As a non-limiting example, the graph in FIG. 11 shows a force-displacement curve for one or more springs, of the same length, in parallel where the resulting spring constant is 40 N/m. The one or more springs may comprise a single spring with a spring constant of 40 N/m, or two individual springs in parallel where each spring has a spring constant of 20 N/m, or some other combination of one or more springs of the same length where the resulting spring constant is 40 N/m. In this system, as shown below, when 10N of force is applied to the one or more springs, the springs displace 0.25 m. When 14N of force is applied to the one or more springs, the springs displace 0.35 m. When 20N of force is applied to the one or more springs, the springs displace 0.5 m.

In some embodiments, the exercise device 100 may comprise two springs 500, wherein the two springs 500 have different lengths, but the same spring constant. The second spring 500 may have a length that is 0.25 m greater than the first spring 500. The springs 500 may be disposed between an elongate strap 400 and a handle strap 555. In this configuration, the first spring 500 may be shorter than the second spring 500. Since the springs 500 have different lengths, there may be a point at which only the first spring 500 is providing resistance. A user may apply enough force to the first spring 500, such that its stretched length is approximately equal to the length of the unstretched second spring 500. If any more force is applied, the second spring 500 may begin to provide resistance. In this case, the spring constant of the two springs 500 may be different depending on whether the second spring 500 is providing resistance. The spring constant of the first spring 500 alone (before the second spring 500 provides resistance) may be less than the spring constant of the two springs 500 in parallel (after the second spring 500 provides resistance). In this sense, the spring constant of the two-spring system changes depending on how much force is applied and how much the first spring 500 is displaced.

Figure 12:
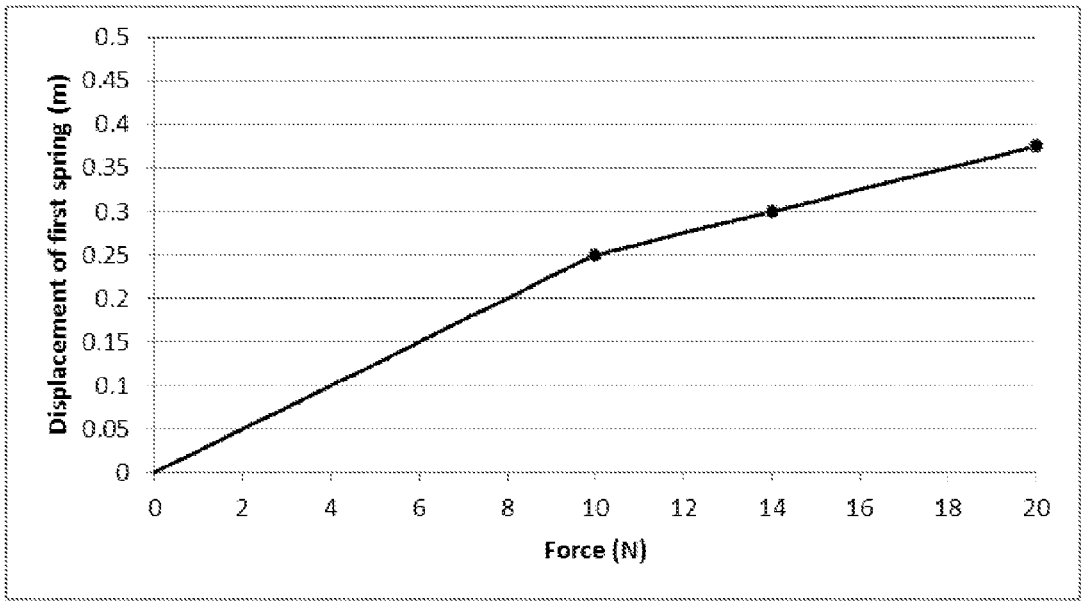
FIG. 12 illustrates a second force/displacement chart.

The graph in FIG. 12 shows a force-displacement curve for two springs in parallel where the first spring has a spring constant of 40 N/m and the second spring has a spring constant of 40 N/m, and the second spring is 0.25 m longer than the first spring. Similar to the graph in FIG. 11, when 10N is applied to the two springs, the first spring displaces 0.25 m. This is also the point at which the second spring begins to provide resistance. If any more force is applied, the second spring will begin to provide resistance and the spring constant for the two springs from this displacement and farther, will be larger than the spring constant of the first spring individually. If the second spring has a spring constant of 40 N/m, then the resulting spring constant of the two springs in parallel, for displacements greater than 0.25 m, will be 80 N/m, or twice that of either spring individually. Therefore, when 10N of force is applied to the two springs, the first spring displaces 0.25 m and the second spring does not displace (because its length is 0.25 m greater than the first spring). This result is similar to FIG. 11. When 14N of force is applied to two springs, the first spring displaces 0.3 m, and the second spring stretches from 0.25 m to 0.3 m. In this scenario, the first spring applies 12N of force resistance and the second spring applies 2N of force resistance. When 20N of force is applied to the two springs, the first spring displaces 0.375 m, and the second spring displaces 0.125 m. In this scenario, the first spring applies 15N of force and the second spring applies 5N of force.

In some embodiments, the exercise device 100 may comprise two springs 500, wherein the two springs 500 have different lengths, but the same spring constant, and also comprise a lower strap 450 disposed between an elongate strap 400 and a handle strap 555. The lower strap 450 may attach to the elongate strap 400 at the same or similar place as do the two springs 500, and may attach to the handle strap 555 at the same or similar place as do the two springs 500. The lower strap 450 may have a length greater than either the first or second springs 500, and may have a length that is 0.3 m greater than the first spring 500, and 0.05 m greater than the second spring 500. In this configuration, when the user applies any force up to 14N, the two springs 500 will stretch up to 0.3 m, and may generally act as if the lower strap 450 is not attached. Since the lower strap 450 is 0.3 m longer than the first spring 500, the first spring 500 must displace 0.3 m before the lower strap 450 becomes engaged. However, once more than 14N of force is applied to the first spring 500, the second spring 500, and the lower strap 450, the lower strap 450 will not elongate further.

Figure 13:
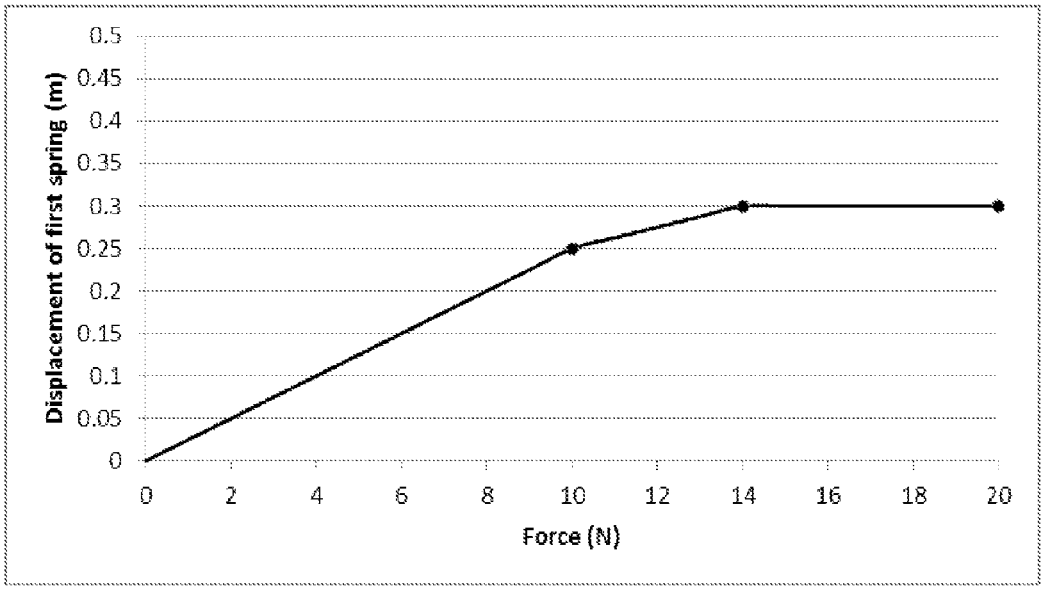
FIG. 13 illustrates a third force/displacement chart.

The graph in FIG. 13 shows a force-displacement curve for two springs and a static strap in parallel, where the first spring has a spring constant of 40 N/m and the second spring has a spring constant of 40 N/m, the second spring is 0.25 m longer than the first spring, and the static strap is 0.3 m longer than the first spring and 0.05 m longer than the second spring. Similar to the graphs in FIGS. 11 and 12, when 10N is applied to the two springs and strap, the first spring displaces 0.25 m. And similar to the graph in FIG. 12, when 14N of force is applied to the two springs and strap, the first spring displaces 0.3 m and the second spring stretches from 0.25 m to 0.3 m. However, when more than 14N is applied to the two springs and strap, the first spring will only displace 0.3 m and the second spring will only stretch from 0.25 m to 0.3 m. Any additional force applied, may be resisted by the lower strap 450. For instance, if 20N of force is applied, the first spring 500 will displace 0.3 m and apply 12N of force resistance, the second spring 500 will displace from 0.25 m to 0.3 m and apply 2N of force resistance, and the static strap will not stretch or elongate and will apply 6N of force resistance. Any force applied greater than 20N may be resisted by an equal and opposite resistance force from the lower strap 450.

The above examples involving at least one spring 500 and in some instances one or more springs 500 and/or a lower strap 450 are for illustrative purposes only and do not limit the scope of the invention. This includes the configurations and embodiments described, as well as the graphical depictions in FIGS. 11-13. More or fewer springs or straps, in parallel or series may be added to the exercise device or comprise the exercise device depending on the configuration and/or the result desired.

It may be advantageous for an exercise device 100 to comprise one or more springs and/or straps, in parallel or series. Some exercises that are available to an exercise device 100 may work well with a static strap. However, the exercise may work equally well with at least one spring 500 attached to the exercise device 100. The exercise may target different muscles or parts of the user's body depending on whether a spring or strap is used. In some embodiments, a user may benefit from a configuration of an exercise device 100 where the spring constant is not the same throughout the entire range of the exercise motion. For instance, a user may benefit from the beginning movement of the exercise motion to be relatively easy with little elastic resistance exerted by the spring. However, the user may also benefit from more resistance further in to the exercise motion. This may be accomplished by using a configuration similar to that described above where the exercise device 100 comprises two springs 500 in parallel with the first spring 500 shorter than the second spring 500. In this configuration, the exercise device 100 may provide more resistance during the second part of the exercise motion than the first part of the exercise motion.

In some embodiments, a user may benefit from an exercise device 100 that comprises two springs 500 in parallel, with the first spring 500 shorter than the second, and a lower strap 450 that is longer than the second spring 500. In this configuration, the first part of the exercise motion may be easier than the second part of the exercise motion, and the second part of the exercise motion may be easier than a third part of the exercise motion where the lower strap 450 provides resistance force. In some embodiments, the lower strap 450 may be substituted with a third spring 500 to provide a different user experience that may be beneficial in some exercise movements.

Figure 10:
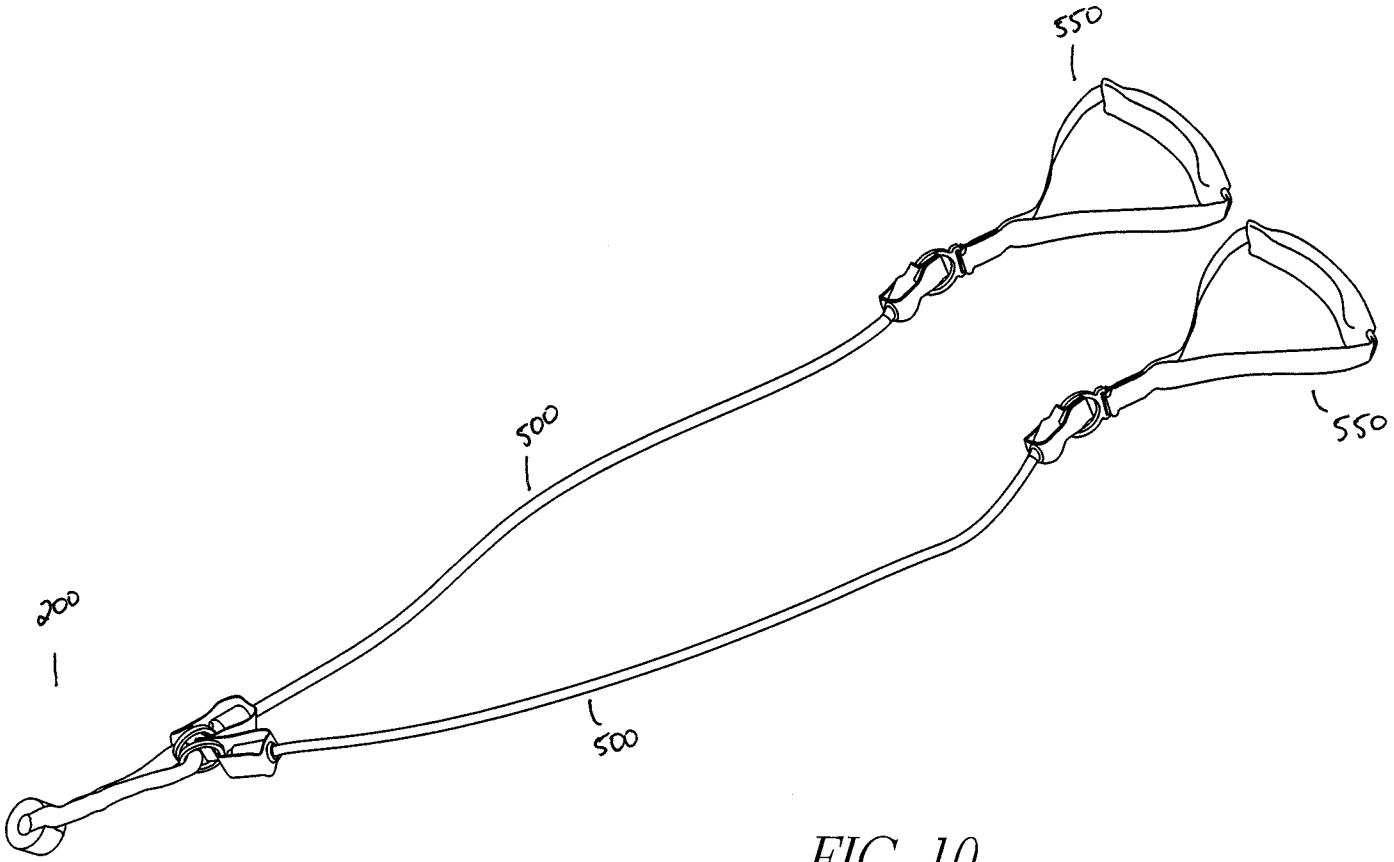
FIG. 10 illustrates an embodiment of the invention.

In some embodiments, an exercise device 100 may comprise two springs 500, one attached to each elongate strap 400, and two handles 550, one attached to each spring 500. The exercise device 100 may be configured such that the springs 500 comprise a connector 420 at a first end of each spring, and may be detachable from the elongate straps 400. At least part of the anchor portion 200 may be configured such that the anchor strap 210 may be detachable from the upper strap 250. The connectors of each spring 420 may then be connected to at least a portion of the anchor portion 200, such as the anchor strap 210, wherein the anchor strap 210 may not be connected to the upper strap 250. The result may be a smaller, more compact exercise device 100 that may be capable of providing at least some of the benefits of a different embodiment of an exercise device 100. For instance, as shown in FIG. 10, a user may connect the springs 500 at least directly to the anchor strap 210 using connectors. The user may secure the obstruction device 205 to a suitable structure. The user may be able to perform various upper-body exercises such as the lat row or chest press, or lower-body exercises such as a standing hip abductor exercise. The user may also be able to perform exercises even if the obstruction device 205 is not connected to a suitable structure. For instance, the exercise device 100 may be configured such that the springs 500 are connected to the anchor strap 210 or to each other, and the user may be able to exercise his shoulders by moving his hands away from each other. The springs 500 may be configured such that as the user moves his hands away from each other, the springs 500 provide tensile resistance against the user's movement. In some embodiments, a first handle 550 may be connected to a first end of a single spring 500, with a second handle 550 connected to a second end of the spring 500. This configuration may also provide the user with available exercises. In some embodiments (not shown), the two handles may be connected to two springs respectively, and the two springs may be connected to each other using a connector such as a carabiner. Other configurations using one or more handles, one or more springs, the anchor, and one or more straps may be possible. The various configurations may be at least partially influenced by the user's preference.

An exercise device 100 that can be separated in to components and reattached into different configurations may be advantageous to a user. For instance, a user may desire to use an exercise device 100 while traveling. It may be advantageous for the exercise device 100 to be configured to allow the user to take parts of the exercise device 100 while traveling and be able to perform different exercises. The user may desire to take all parts of the exercise device 100 in order to be able to perform all of the available exercises; or the user may desire to take only some components of an exercise device 100 and perform the exercises that may be performed with only those components. Since the user may have different options as to configurations, the user may appreciate the ability to customize the exercise device 100 depending on his or her needs for a particular trip or situation. Other configurations may be possible for an exercise device 100 and the scope of the invention is not limited to the configurations explicitly described herein.

The length of the elongate straps 400 may be variable such that the length can be increased or decreased. The elongate straps 400 may be configured to allow changes to the length using an elongate strap adjuster 410, which may comprise a ladder lock buckle. In some embodiments, a strap adjuster 410 is disposed on or near an elongate strap 400. The elongate strap 400 may comprise two ends with the first end connected or connectable to a lower strap 450, a spring 500, or a handle 550. The elongate strap 400 may extend from the first end, through the strap adjuster 410, through an eyelet strap connector 335, eyelet of the main connector 325, or some other portion of the main connector 300, then back down to the adjuster 410, wherein a second end of the elongate strap 400 may be attached or connected to the adjuster 410. The elongate strap 400 and strap adjuster 410 may be configured such that the adjuster 410 may slide or move along at least part of the elongate strap 400. An adjuster grip 415 may be connected to the elongate strap adjuster 410 and may allow a user to more easily change the location of the adjuster 410 along the elongate strap 400.

An exercise device 100 that comprises an elongate strap 400 comprising an adjuster 410 that may slide or move along at least part of the elongate strap 400 to alter the distance between the main connector 300 and the spring 500 or handle 550, may be advantageous. Different exercises may benefit from the elongate straps 400 being longer or shorter, and a user may appreciate the ability to quickly and easily change the length of the elongate strap 400 depending on the exercise he prefers to do. In addition, it may be beneficial for the strap adjuster 410 to be disposed between the main connector 300 and the handle 550 and generally away from the handle 550. When performing exercises, a user may find it uncomfortable for an adjuster 410 to be right next to his hands and/or wrists. Different exercises may require the elongate strap 400 to be near or touching the users hands, wrists, or arms, and an adjuster 410 that is too close to the user's hands may provide discomfort. Therefore, it may be advantageous for the exercise device 100 to comprise an elongate strap adjuster 410 that is not adjacent the handles 550.

As used in this disclosure, the terms and labels should generally be given their plain and ordinary meaning. For instance, the term "strap" should generally be interpreted to include, without limitation, a strip of pliant material that may be long and narrow. It may comprise various materials including, without limitation, nylon. The term "spring" should generally be interpreted to include, without limitation, an elastic device that at least partially regains its original shape after being compressed or extended. It may include, without limitation, elastic devices made of metal, plastic, rubber, nylon, or other materials that comprise or define a spring constant over at least part of the device's displacement. The term "handle" should generally be interpreted as including, without limitation, a part that is configured to be held or operated by one's hand, but may also include a part that may be operated by other parts of one's body. The term "connector" should generally be interpreted to include, without limitation, a device providing a connection between at least two parts. The term "anchor" should generally be interpreted to include, without limitation, a source of securing or stability and/or a point of support.

In some embodiments, a method using the exercise device may include: securing an anchor portion to a generally stable object; gripping one or more handles with one or more body parts; and applying a tensile force to the exercise device in a direction generally opposite from the anchor portion.

In some embodiments, a method of using the exercise device may include any of the following steps: securing an anchor portion to a generally stable object; adjusting the upper strap to a desired length; adjusting the length of an elongate strap by moving or sliding a buckle along the elongate strap either towards or away from the handles; connecting a lower strap to the handle portion; disconnecting a lower strap from a handle portion; connecting a lower strap to the elongate strap; connecting a first spring to the handle portion; disconnecting a first spring from the handle portion; and connecting or disconnecting a second spring to or from the handle portion. In some embodiments, the step of securing an anchor portion to a generally stable object may include wrapping an upper strap around a stable object and adjusting the length of the upper strap.

In some embodiments, a method of using the exercise device may include: connecting a first handle portion to a first end of a first spring; connecting a second handle portion to a first end of a second spring; and connecting the second end of the first spring to the second end of the second spring, either directly or indirectly. The method may further comprise any of the following steps: connecting the second end of the first spring to an anchor portion; connecting the second end of the second spring to an anchor portion; securing the anchor portion to a generally stable object. An exercise device in configured in these embodiments may be of substantially the same, or similar, length as commercial exercise bands available. Thus, the exercise device may be versatile in that it can be adapted to multiple configurations that may mimic or be close substitutes for individual pieces of exercise equipment that must usually be purchased separately and cannot be easily integrated into other exercise equipment systems. A method to use the exercise device in any of these embodiments may comprise placing a portion of the springs on the floor, wherein the portion of the springs placed on the floor may include the approximate middle of the springs and/or the approximate location where the first and second springs engage; gripping the handles of the exercise device; moving at least one of the handles in either an upward and/or outward movement; and returning the at least one handle to a rest position, wherein the rest position may be a location where the spring is substantially unstretched, or less extended as compared to other portions of the exercise motion.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein. Additionally, a person having ordinary skill in the art will readily appreciate, the terms "upper" and "lower" are sometimes used for ease of describing the figures, and indicate relative positions corresponding to the orientation of the figure on a properly oriented page, and may not reflect the proper orientation of the device as implemented.

Certain features that are described in this specification in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example processes in the form of a flow diagram. However, other operations that are not depicted can be incorporated in the example processes that are schematically illustrated. Additionally, other implementations are within the scope of the following claims. In some cases, the actions recited in the claims can be performed in a different order and still achieve desirable results.

In describing the present technology, the following terminology may have been used: The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" means quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but also include individual values and sub-ranges within the indicated range. Thus, included in this numerical range are individual values such as 2, 3 and 4 and sub-ranges such as 1-3, 2-4 and 3-5, etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

It should be noted that various changes and modifications to the presently preferred embodiments described herein will be apparent to those skilled in the art. Such changes and modifications may be made without departing from the spirit and scope of the invention and without diminishing its attendant advantages. For instance, various components may be repositioned as desired. It is therefore intended that such changes and modifications be included within the scope of the invention. Moreover, not all of the features, aspects and advantages are necessarily required to practice the present invention. Accordingly, the scope of the present invention is intended to be defined only by the claims that follow.

What is claimed is:

1. A portable exercise system comprising:

an anchor portion comprising an obstruction device connected by a first anchor strap to a second anchor strap, the second anchor strap comprising an opening and a connector, a size of said opening being continuously adjustable and firmly securable to a vertical object along the height of a standing user, the exercise system being selectively anchored either by the obstruction device or the opening;

a first elongate strap and a second elongate strap, each elongate strap being inelastic and comprising an upper strap portion and a lower strap portion continuous with the upper strap portion, the lower strap portion having a first upper end and a detachable second lower end;

a first handle and a second handle; and a first spring and a second spring;

wherein said anchor portion is at least one of connected and connectable to said first elongate strap and said second elongate strap using a swivel connector, the swivel connector being sized to prevent free movement of the first and second elongate straps through the swivel connector and limiting the length of said first and second elongate straps; and wherein each of said first and second handles is connected to the anchor portion by each of said respective first and second elongate straps, including the detachable lower strap portion and the upper strap portion of each elongate strap, each lower strap portion being connected to its respective upper strap portion at a first upper connector and to its respective handle at a second lower connector;

said first spring and said second spring being configured to attach to said exercise system and be disposed parallel to at least part of, respectively, said lower strap portion of said first elongate strap and to said lower strap portion of said second elongate strap, each spring being attached to said exercise system at its respective first upper connector and at its second lower connector, each lower strap portion being detachable from its respective second lower connector to expose only each respective spring to tension, each lower strap portion being re-attachable to the exercise system at its respective upper strap portion, whereby the exercise system is configured to have two modes of operation: inelastic when each lower strap portion is attached to its respective second lower connector, and elastic when each lower strap portion is detached therefrom.

2. The exercise system of claim 1, further comprising third and fourth springs configured to be connected to said exercise system parallel to each of said first and second springs.

3. The exercise system of claim 2, wherein said third spring and said fourth spring are different lengths compared to said first and second springs when unstretched.

4. The exercise system of claim 1, wherein each of said first and second springs comprises an elastic exercise band.

5. The exercise system of claim 1, wherein each of said first and second elongate straps comprises static nylon webbing.

6. The exercise system of claim 1, wherein said anchor portion comprises an obstruction device and at least one strap.

7. The exercise system of claim 1, wherein each of said first and second springs is connectable to said anchor portion.

8. A portable exercise system comprising:

an anchor portion;

a first elongate strap and a second elongate strap, each elongate strap being inelastic and comprising an upper strap portion and a lower strap portion continuous with the upper strap portion, the lower strap portion having a first upper end and a detachable second lower end;

a first handle and a second handle;

a first spring and a second spring; and a swivel connector;

wherein said anchor portion is connected to said first and second elongate straps by said swivel connector, such that said anchor portion is configured to rotate independent of said first and second elongate straps; and wherein said first handle is at least one of connected and connectable to said first elongate strap and said second handle is at least one of connected and connectable to said second elongate strap;

wherein each of said first and second handles is connected to the anchor portion by each of said respective first and second elongate straps, including the detachable lower strap portion and the upper strap portion of each elongate strap, each lower strap portion being connected to its respective upper strap portion at a first upper connector and to its respective handle at a second lower connector;

said first spring and said second spring being configured to attach to said exercise system and be disposed parallel to at least part of, respectively, said lower strap portion of said first elongate strap and to said lower strap portion of said second elongate strap, each spring being attached to said exercise system at its respective first upper connector and at its second lower connector, each lower strap portion being detachable from its respective second lower connector to expose only each respective spring to tension, each lower strap portion being re-attachable to the exercise system at its respective upper strap portion.

9. The exercise system of claim 8, wherein said anchor portion is configured to be continuously adjustable in length.

10. The exercise system of claim 8, wherein each of the first and second elongate straps comprises two nylon straps.

11. The exercise system of claim 10, wherein said two elongate nylon straps are sewn together at generally consistent intervals.

12. A portable exercise system comprising:

an anchor portion;

a swivel connector;

a first elongate strap and a second elongate strap, each elongate strap being inelastic and comprising an upper strap portion and a lower strap portion continuous with the upper strap portion, the lower strap portion having a first upper end and a detachable second lower end;

a first handle and a second handle; and a first spring and a second spring;

wherein said anchor portion is at least one of connected and connectable to said first and second elongate straps using the swivel connector; and wherein a first end of said first and second springs is at least one of connected and connectable to respective said first and second elongate straps and a second end of said first and second springs is at least one of connected and connectable to respective said first and second handles;

wherein each of said first and second handles is connected to the anchor portion by each of said respective first and second elongate straps, including the detachable lower strap portion and the upper strap portion of each elongate strap, each lower strap portion being connected to its respective upper strap portion at a first upper connector and to its respective handle at a second lower connector;

said first spring and said second spring being configured to attach to said exercise system and be disposed parallel to at least part of, respectively, said lower strap portion of said first elongate strap and to said lower strap portion of said second elongate strap, each spring being attached to said exercise system at its respective first upper connector and at its second lower connector, each lower strap portion being detachable from its respective second lower connector to expose only each respective spring to tension, each lower strap portion being re-attachable to the exercise system at its respective upper strap portion, whereby the exercise system is configured to have two modes of operation: inelastic when each lower strap portion is attached to its respective second lower connector, and elastic when each lower strap portion is detached therefrom.

13. The exercise system of claim 12, wherein said anchor portion is configured to be secured to at least part of a door.

14. The exercise system of claim 13, wherein said anchor portion is secured to at least part of a door by placing at least part of said anchor portion between said door and a door frame associated with said door, and closing said door.

15. The exercise system of claim 12, wherein said anchor portion is configured to be secured to and wrapped around a generally stationary object.

16. The exercise system of claim 12 wherein the distance from each handle to each respective first upper connector is adjustable, and wherein the resistance of the exercise system is adjustable, by varying the length of the lower strap portion and the spring.

17. The exercise system of claim 16 wherein the lower strap portion remains attached to the second lower connector and is one of: shorter than the spring, longer than the spring, same length as the spring.

* * * * *

UNITED STATES PATENT AND TRADEMARK OFFICE

CERTIFICATE OF CORRECTION

PATENT NO. : 8,979,716 B1
APPLICATION NO. : 14/310912
DATED : March 17, 2015
INVENTOR(S) : Kenneth C. Rawlins It is certified that error appears in the above-identified patent and that said Letters Patent is hereby corrected as shown below:

In The Specification

In column 2 at line 27, Change “faun” to --form--.

In column 5 at line 33, Change “the a” to --the--.

In column 6 at line 3, Change “an the” to --on the--.

Signed and Sealed this
Tenth Day of May, 2016

Michelle K. Lee

Michelle K. Lee
*Director of the United States Patent and Trademark Office*